US008342891B2

(12) United States Patent
Fukushi

(10) Patent No.: US 8,342,891 B2
(45) Date of Patent: Jan. 1, 2013

(54) ELECTRICAL CONNECTOR

(75) Inventor: Makoto Fukushi, Sagamihara (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 13/319,135

(22) PCT Filed: May 12, 2010

(86) PCT No.: PCT/US2010/034488

§ 371 (c)(1),
(2), (4) Date: Nov. 7, 2011

(87) PCT Pub. No.: WO2010/132530

PCT Pub. Date: Nov. 18, 2010

(65) Prior Publication Data

US 2012/0052736 A1 Mar. 1, 2012

(30) Foreign Application Priority Data

May 15, 2009 (JP) ..... 2009-119198

(51) Int. Cl.
*H01R 13/502* (2006.01)

(52) U.S. Cl. ..... 439/752; 439/441; 439/686; 439/891

(58) Field of Classification Search ..... 439/135–142, 439/440–441, 686, 752, 891
See application file for complete search history.

(56) References Cited

U.S. PATENT DOCUMENTS

| | | | | |
|---|---|---|---|---|
| 6,533,600 | B1 | 3/2003 | Kashiyama et al. | |
| 7,094,098 | B2 * | 8/2006 | Miyazaki | 439/559 |
| 2002/0119693 | A1 | 8/2002 | Chen | |
| 2007/0272609 | A1 * | 11/2007 | Suri et al. | 210/603 |
| 2007/0281555 | A1 * | 12/2007 | Suemitsu et al. | 439/752 |
| 2008/0009201 | A1 * | 1/2008 | Hiramatsu | 439/752 |
| 2008/0261460 | A1 | 10/2008 | Hariharesan et al. | |

OTHER PUBLICATIONS

PCT International Search Report from PCT/US2010/034488 mailed on Nov. 30, 2010, 3 pages.

* cited by examiner

*Primary Examiner* — Edwin A. Leon
*Assistant Examiner* — Larisa Tsukerman
(74) *Attorney, Agent, or Firm* — Robert S. Moshrefzadeh

(57) ABSTRACT

In one aspect, provided is an electrical connector that can improve reliability of signal connection by ensuring insulation between adjacent terminals. In one aspect, connector housing 2 has front housing 3 and rear housing 4 that are combined together during assembly and that have respective partition walls 10 and 11 to define terminal accommodation chambers 8 and 9, respectively, and wherein movable wall 15 is provided to extend from partition wall 11 of rear housing 4 to displace and connect to partition wall 10 of front housing 3 when both housings 3 and 4 are combined together.

4 Claims, 5 Drawing Sheets

ELECTRICAL CONNECTOR

CROSS REFERENCE TO RELATED APPLICATIONS

This application is a national stage filing under 35 U.S.C. 371 of PCT/US2010/034488, filed 12 May 2010, which claims priority to Japanese Application No. 2009-119198, filed 15 May 2009, the disclosure of which is incorporated by reference in its/their entirety herein.

BACKGROUND

The present invention relates to an electrical connector for interconnecting between electrical wires and mating connectors, wherein a pitch between a plurality of terminals accommodated in terminal accommodation chambers of a connector housing is different between one end and the other end of the connector housing.

Japanese Unexamined Patent Publication No. S63-170870 describes an example of a so-called pitch conversion connector, that is to say, a connector in which a pitch between a plurality of terminals accommodated in terminal accommodation chambers of a connector housing is different between two ends of the connector housing, wherein, in general, one of the two ends fits with another connector and the other connects with a cable or a substrate. On page 2, from line 20 of the top left-hand column to line 9 of the top right-hand column, there is a description explaining that a pitch between the terminals accommodated in the connector housing is different between a contact part and a connection part. It reads: "As can be seen from the figures, a pitch between contact parts 11 or, in other words, a space B between 11*a* and 11*b* corresponds to mating plugs that are not illustrated, while a pitch between wire connection parts 12 or, in other words, a space A between 12*a* and 12*b* corresponds to flat cables to be connected that are not illustrated."

Further, FIG. 2 of JP S63-170870 illustrates a state in which a plurality of terminals are accommodated in the connector housing at predetermined intervals. As set forth on page 2, lines 9-13 of the top left-hand column, each terminal has: the contact part to be connected with the plug at one longitudinal end; the wire connection part to be connected with the cable at the other longitudinal end; and a bent coupling part between the contact part and the wire connection part. The contact parts and wire connection parts of individual terminals are not only held by wall parts of the connector housing but also insulated from each other so as not to make contact with the adjacent contact parts and wire connection parts, respectively.

SUMMARY

If the insulating walls are not provided between the adjacent terminals, the adjacent terminals may be short-circuited by dust or foreign matter penetrating the inside of the connector housing. This problem is likely to occur especially when the spaces between the adjacent terminals are narrow. The penetration of the dust or foreign matter may occur not only during assembly of the connector but also during use, for example, upon mating and unmating of the connector. When high voltage and large current are supplied to the connector, the risk of short-circuits between the adjacent terminals is increased.

In one aspect, the present invention provides an electrical connector that can improve reliability of signal connection by ensuring insulation between adjacent terminals.

In one aspect, the present invention provides an electrical connector in which a pitch between a plurality of terminals accommodated in terminal accommodation chambers of a connector housing is different between one end and the other end of the connector housing, wherein the connector housing comprises a first housing and a second housing that are combined together during assembly and that have respective partition walls to define said terminal accommodation chambers, and wherein a movable wall is provided to extend from said partition wall of one housing to displace to said partition wall of the other housing when the first housing and the second housing are combined together.

In the electrical connector according to the present invention, because the movable wall is provided to extend from the respective partition walls of one housing to displace and connect to the respective partition walls of the other housing when the first housing and the second housing are combined together, the movable walls form respective portions of partition walls that define the terminal accommodation chambers and, as a result, insulation between the adjacent terminals can be ensured and reliability of signal connection can be improved.

DETAILED DESCRIPTION

An electrical connector of the present invention is a pitch conversion connector in which a pitch between a plurality of terminals is different between one end and the other end of a connector housing. The application of this electrical connector is not limited to this embodiment but it can be applied to electrical interconnection between various electrical components. As an example, the electrical connector of the present invention can be applied to connection with an output interface of a sequencer in an FA (Factory Automation) apparatus, wherein the connector housing comprises two, front and rear or first and second housings that are combined together during assembly, and wherein movable walls are provided to extend from respective partition walls that define terminal accommodation chambers of one housing to displace and connect to respective partition walls of the other housing. As a result, in the electrical connector of the present invention, independence of the terminal accommodation chambers can be ensured by the movable walls extending from the respective partition walls and the adjacent terminals are insulated from each other so that reliability of signal connection can be improved.

Figure 1:
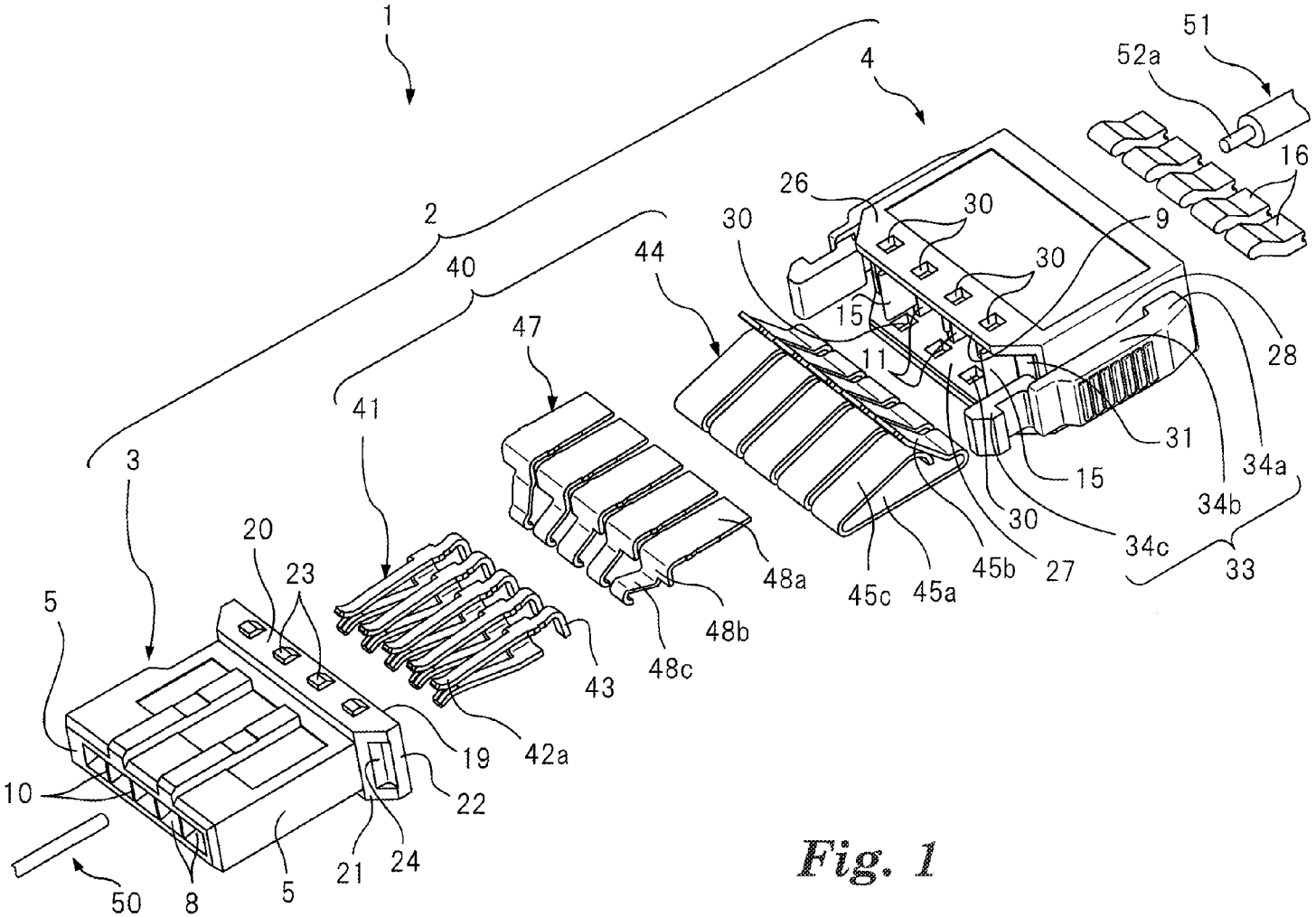
FIG. 1 is an exploded perspective view of an electrical connector according to a first embodiment of the present invention.

Hereinafter, the electrical connector of the present invention will be described with reference to the drawings. FIG. 1 illustrates an electrical connector according to one embodiment of the present invention. As illustrated in the figure, electrical connector 1 of this embodiment is a 5-terminal connector in which terminals are arranged in a single line and has: connector housing 2 having a plurality of terminal accommodation chamber 8 and 9; and terminals 40 accommodated in respective terminal accommodation chambers 8 and 9. Each terminal 40 can be comprised of three types of terminals 41, 44 and 47 that are formed by bending the elements stamped from electrically conductive metal sheets by a metal stamping process, but it is not limited to this embodiment. First terminal 41 is a female terminal that has female electrical contact part (terminal contact part) 42*a* to be connected with male terminal 50 of a mating connector (not illustrated), second terminal 44 is a cable connection terminal that has cable connection part (wire connection part) 45*b* to be connected with cable (wire) 51, and third terminal 47 is a joint terminal that is disposed between first terminal 41 and second terminal 44 and adjusts the pitch between terminals. In this embodiment, as third terminals 47, 5 types of terminals of different shapes are used. As first terminals 41 and second terminals 44, one respective type, each having its identical shape and size, of terminals is used.

In this embodiment, first to third terminals 41, 44 and 47 are assembled, so that terminals 40 of a complex configuration can be manufactured easily. Each of first terminals 41 has the same shape. Each of second terminals 44 has the same shape. Each of third terminals 47 has five different shapes. Further, each pair of respective second and third terminals 44 and 47 is configured by separate elements that sandwich electrical conductor part 52*a* of each cable 51 therebetween in this embodiment. However, if electrical conductor part 52*a* of each cable 51 is pressure-connected to a tuning fork-like part and the like, each pair of second and third terminals can be formed as an integral part. First terminals 41 correspond to a first part of the terminal accommodated in front housing 3, and second and third terminals 44 and 47 correspond to a second part accommodated in rear housing 4. Second terminals 44 are formed of an electrically conductive material in this embodiment, but second terminals 44 can also be formed of a non-electrically conductive material, since second terminal 44 has a function for biasing electrical conductor part 52*a* of cable 51 by spring force of second terminal 44, so that electrical conductor part 52*a* of cable 51 connects with cable connection plate part 48*a* of third terminal 47.

Figure 2:
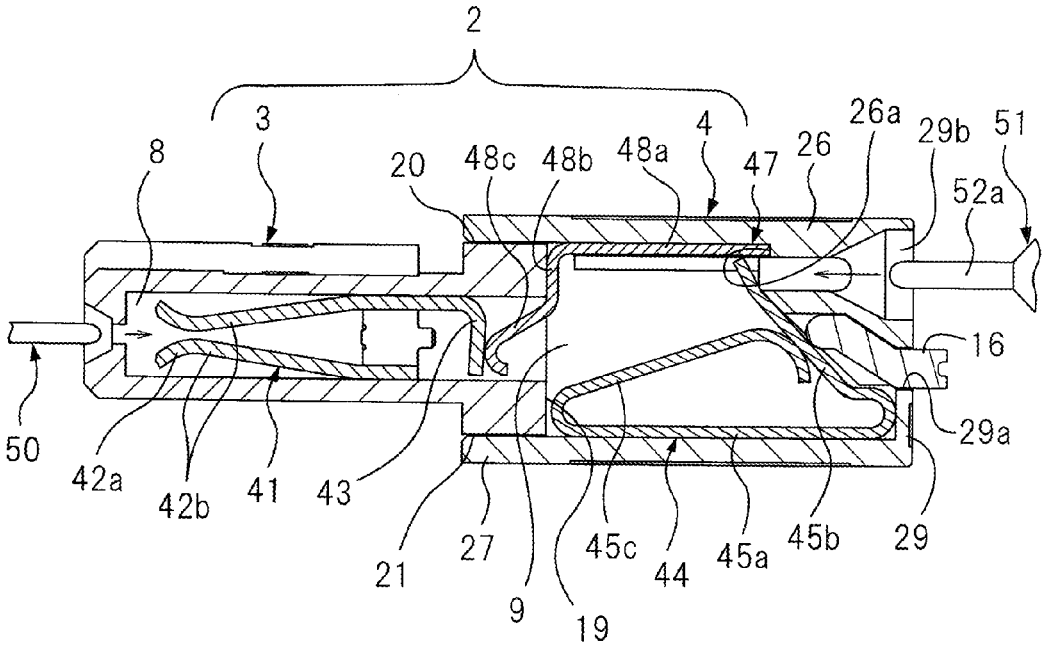
FIG. 2 is a cross-sectional view of a terminal accommodated in a terminal accommodation chamber of the electrical connector illustrated in FIG. 1.

FIG. 2 illustrates a state in which a set of first to third terminals 41, 44 and 47 are assembled inside connector 1. Female electrical contact part 42*a* formed at one end of first terminal 41 has a pair of spring contact pieces 42*b* vertically facing each other. Male terminal 50 of the mating connector is inserted from a tip side where the space between the pair of spring contact pieces 42*b* facing each other is shortest, and held by spring force of the pair of spring contact pieces 42*b*. At the other end of first terminal 41, contact part 43 is formed by bending an end of upper spring contact piece 42*b* in a downward direction by about 90°. An end of third terminal 47 abuts against this contact part 43 at a predetermined contact pressure. Second terminal 44 has: bottom part 45*a*; cable connection part 45*b* that extends from one side of bottom part 45*a* and forms an acute angle with bottom part 45*a*; and spring support part 45*c* that extends from the other side of bottom part 45*a* and forms an acute angle with bottom part 45*a* and, at the same time, abuts with its curved tip against an inner surface of cable connection part 45*b* to elastically support cable connection part 45*b*.

Third terminal 47 has: a flat and broad cable connection plate part 48*a* that holds electrical conductor part 52*a* of cable 51 between cable connection part 45*b* of second terminal 44 and itself; bending part 48*b* that is formed by bending an end of plate part 48*a* in a downward direction by about 90°; and narrow pitch adjustment part 48*c* that extends from bending part 48*b*. Cable connection plate part 48*a* and bending part 48*b* of third terminal 47 have respective identical shapes common to all terminals 47. On the other hand, pitch adjustment part 48*c* of third terminal 47 has different shapes in individual terminals 47, so that, when third terminal 47 are arranged in a single transverse line, pitch adjustment part 48*c* of third terminal 47 disposed in the center is formed straight but pitch adjustment parts 48*c* of third terminals 47 disposed remote from the center are bent toward the center with respect to the root (base) side. Electrical conductor part 52*a* that is exposed by stripping off insulating coating of cable 51 is inserted between cable connection part 45*b* of second terminal 44 and cable connection plate part 48*a* of third terminal 47 through cable insertion hole 29*b* of rear housing 4 and held between cable connection plate part 48*a* and cable connection part 45*b* by spring force of cable connection part 45*b*. Cable connection part 45*b* is configured to exhibit spring force in cooperation with spring support part 45*c*. Magnitude of the spring force is set so as to prevent cable 51 from being pulled out from between cable connection plate part 48*a* and cable connection part 45*b* even when unexpected pulling force is applied to cable 51.

Though electrical conductor part 52*a* of cable 51 is inserted directly between cable connection plate part 48*a* and cable connection part 45*b* in this embodiment, electrical conductor part 52*a* may be provided with a rod terminal (not illustrated) and, then, inserted between cable connection plate part 48*a* and cable connection part 45*b*. The use of the rod terminal is effective, for example, when electrical conductor part 52*a* of cable 51 is inconveniently bent upon insertion between cable connection plate part 48*a* and cable connection part 45*b*. Further, in this embodiment, in order to facilitate insertion of cable 51, lever 16 is provided to press the outer surface of cable connection part 45*b* and bend cable connection part 45*b* downward against the spring force. This lever 16 can be used also when cable 51 is pulled out from between cable connection plate part 48*a* and cable connection part 45*b*. This lever 16 is slidably placed in hole 29*a* that is formed in rear wall 29 of rear housing 4.

Referring again to FIG. 1, connector housing 2 is comprised of two, front and rear housings, or front housing (first housing) 3 and rear housing (second housing) 4 that are separate parts. Two housings 3 and 4 are injection-molded from insulating polymeric material and combined together when connector 1 is assembled. In order to maintain the combined state, a plurality of engagement nails 23 are provided to protrude from top wall 20 and bottom wall 21 of a combining part of front housing 3 to be combined with rear housing 4 and, on the other hand, a plurality of engagement holes 30 are provided to pass through top wall 26 and bottom wall 27 of a combining part of rear housing 4 to be combined with front housing 3 so as to engaged with the plurality of engagement nails 23. Further, engagement grooves 24 are provided in both side walls of the combining part of front housing 3, and engagement protrusions 31 are provided on both side walls 28 of the combining part of rear housing 4 so as to be engaged with engagement grooves 24.

Figure 3:
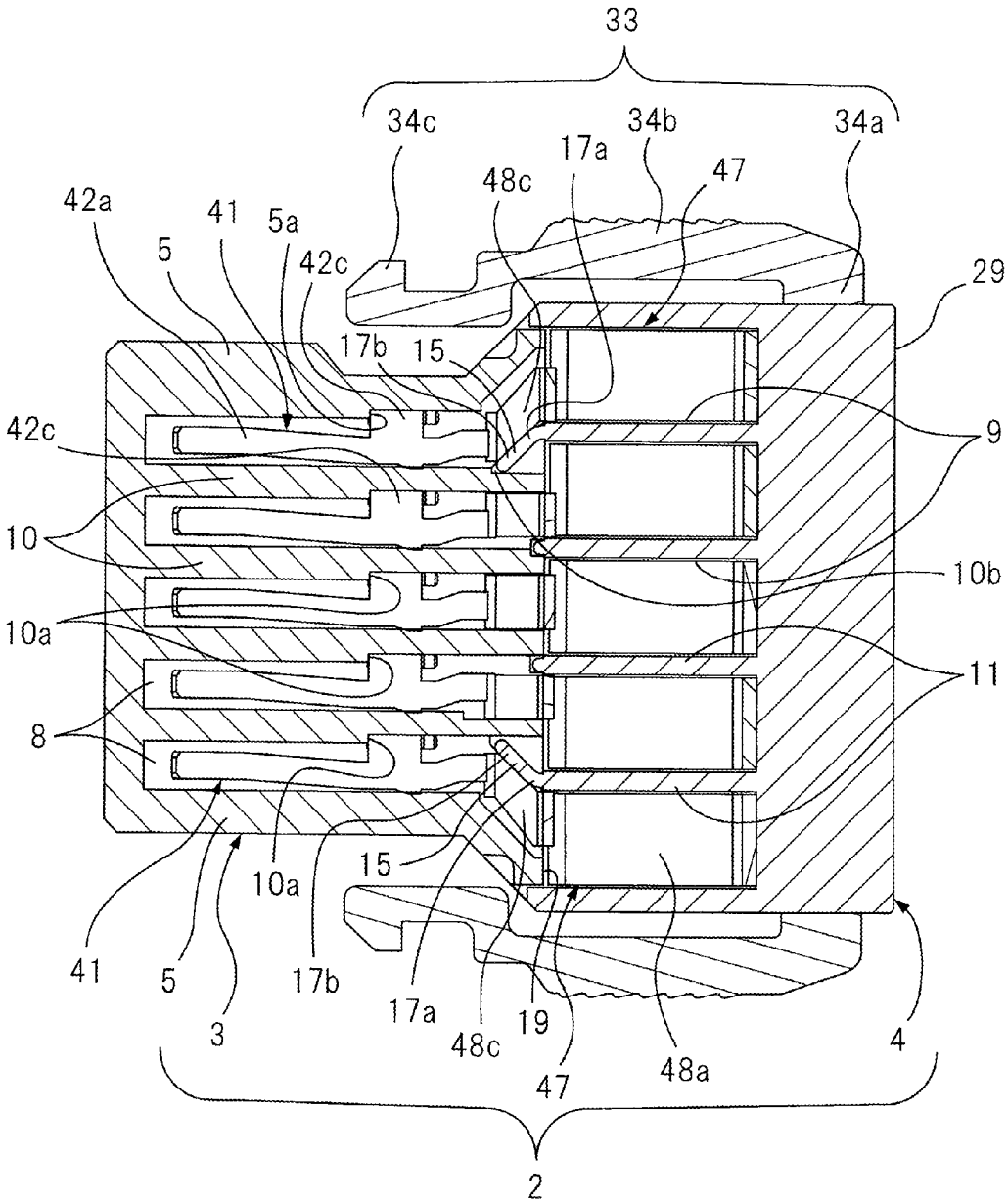
FIG. 3 is a cross-sectional view of the inside of the electrical connector also illustrated in FIG. 1.

First to third terminals 41, 44 and 47 are positioned and accommodated in connector housing 2. As illustrated in FIGS. 2 and 3, each first terminal 41 is accommodated in terminal accommodation chamber 8 of front housing 3 and positioned with respect to front housing 3 (in the terminal inserting (longitudinal) direction) by engagement piece 42*c* abutting against step part 10*a* or 5*a* provided on partition wall 10 or side wall 5 of terminal accommodation chamber 8, respectively. Further, first terminal 41 is prevented from moving in the direction opposite to the terminal inserting direction by contact part 43 abutting against the tip of pitch adjustment part 48*c*. As illustrated in FIG. 2, each second terminal 44 is accommodated in terminal accommodation chamber 9 of rear housing 4 and disposed between the inner surface of rear wall 29 of rear housing 4 and the outer surface of rear wall 19 of front housing 3 so as not to move in the front-rear (longitudinal) direction. As illustrated in FIG. 2, each third terminal 47 is positioned with respect to rear housing 4 by the tip of cable connection plate part 48*a* abutting against step part 26*a* of top wall 26 of rear housing 4. Further, third terminal 47 is prevented from being pulled out from rear housing 4 by the tip of pitch adjustment part 48*c* abutting against contact part 43 of first terminal 41.

Figure 5:
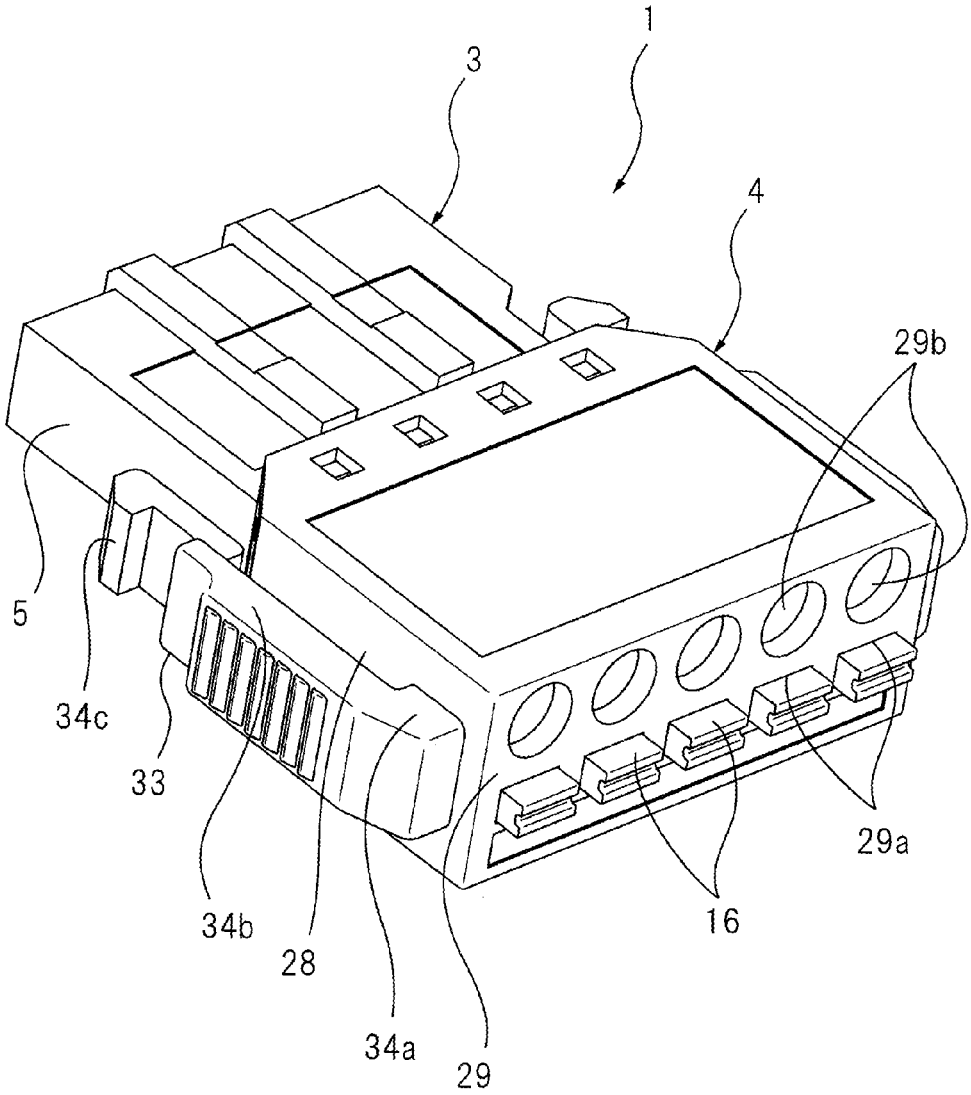
FIG. 5 is an assembly view of the electrical connector also illustrated in FIG. 1.

When both housings 3 and 4 are combined together (as illustrated in FIG. 5), contact part 43 of first terminal 41 and the tip of pitch adjustment part 48*c* of third terminal 47 are pressed against each other to make electrical contact therebetween and, at the same time, male terminal 50 is inserted into female electrical contact part 42*a* and electrical conductor part 52*a* of cable 51 is inserted between second terminal 44 and third terminal 47, so that contact part 43 of first terminal 41 and the tip of pitch adjustment part 48*c* of third terminal 47 can abut against each other by a larger force. Second terminal 44 allows electrical conductor part 52*a* of cable 51 to make electrical contact with pitch adjustment part 48*c* of third terminal 47 and, as its variation, a screw may be attached to a through hole provided in bottom wall 27 of rear housing 4 so as to hold electrical conductor part 52*a* of cable 51 between the tip of the screw and cable connection plate part 48*a*.

The outer surfaces of both side walls 28 of rear housing 4 are provided with a pair of cantilevered locking arms 33 each of which has: base part 34*a* that is coupled with the outer surface of each side wall 28; arm part 34*b* that extends from this base part 34*a* toward the mating connector; and engagement nail part 34*c* at the tip of arm part 34*b*, so that the pair of locking arms 33 can maintain the connection with the mating connector.

Figure 4:
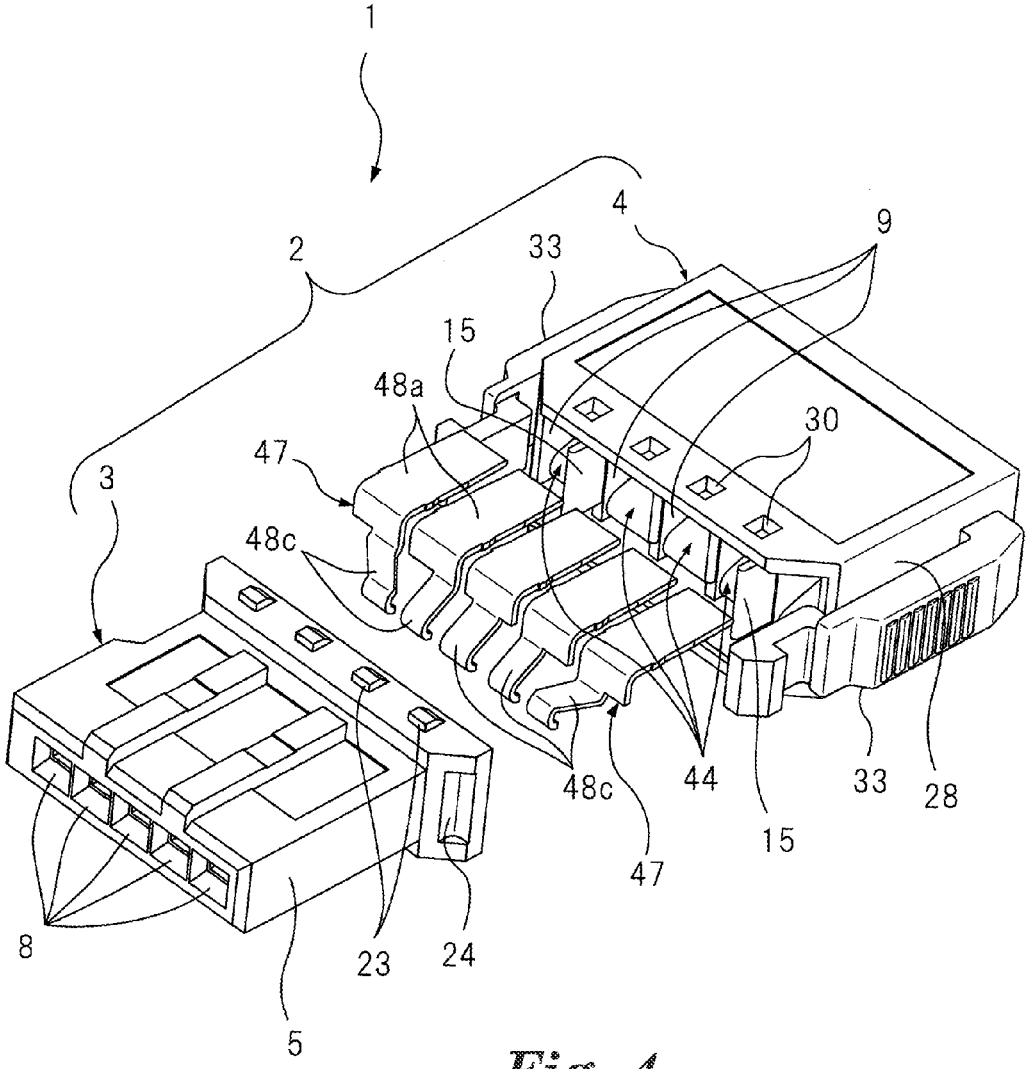
FIG. 4 is a perspective view of a state in which a first housing and a second housing of the electrical connector illustrated in FIG. 1 are separated.

As illustrated in FIGS. 3 and 4, front housing 3 is disposed at the front side in the fitting direction with the mating connector and, as described above, accommodates first terminals 41 that are to be connected with male terminals 50 of the mating connector in respective five terminal accommodation chambers 8 divided by partition walls 10. Rear housing 4 is disposed at the rear side in the connector fitting direction and, similarly to front housing 3, accommodates second terminals 44 and third terminals 47 that are to be connected with cables 51 in respective five terminal accommodation chambers 9 divided by partition walls 11. Terminal accommodation chambers 8 and 9 of both housings 3 and 4 are provided to pass through in the front-rear direction. The space between adjacent terminal accommodation chambers 8 of front housing 3 is smaller than that of terminal accommodation chambers 9 of rear housing 4. Therefore, the pitch between adjacent first terminals 41 accommodated in terminal accommodation chambers 8 of front housing 3 is smaller than that of adjacent second and third terminals 44 and 47 accommodated in terminal accommodation chambers 9 of rear housing 4. As a result, connector 1 of the present invention functions as a pitch conversion connector in which a pitch between a plurality of terminals is different between one end and the other end of connector housing 2.

In general, when two housings in which a pitch between adjacent terminal accommodation chambers is different from each other are combined together, in the part where the both housings are combined together, a displacement of the terminal accommodation chambers occurs between the two housings. The magnitude of the displacement depends on the space between the adjacent terminal accommodation chambers and, if it is large, the terminal accommodation chambers may not uniformly pass through from one end to another (in the front-rear direction) of the connector. Therefore, in JP S63-170870, the interior of the part where the pitch between the terminals is changed is formed hollow. In connector 1 of the present invention, movable walls 15 are provided to extend toward front housing 3 from respective partition walls 11 that define terminal accommodation chambers 9 of rear housing 4, so as to displace along shapes of the terminals when the both housings 3 and 4 are combined together. Thanks to the displacement of movable walls 15, the terminal accommodation chambers are provided to pass through while independence of the individual chambers can be ensured. In other words, partition walls 10 of front housing 3 and corresponding partition walls 11 and movable walls 15 of rear housing 4 are coupled to constitute substantially integral partition walls.

The mode of movable walls 15 is not limited to this embodiment but, as illustrated in FIGS. 3 and 4, cantilevered movable walls 15 can be provided on partition walls 11 that define terminal accommodation chambers 9 disposed at both side ends of terminal accommodation chambers 9 arranged in a single transverse line. Each movable wall 15 has: base part 17*a* that is integrally coupled with partition wall 11; and tip part 17*b* that extends from base part 17*a*, so that movable wall 15 is diagonally inclined with respect to base part 17*a* when both housings 3 and 4 are combined together. Here, each partition wall 11 may be provided with a wall part extending therefrom that resembles movable wall 15 but does not displace. For example, the non-displacing wall parts correspond to those provided on partition walls of terminal accommodation chambers 9 disposed in the center of terminal accommodation chambers 9 arranged in a single transverse line. When both housings 3 and 4 are combined together, movable walls 15 are urged by respective pitch adjustment parts 48*c* of terminals 40 (third terminals 47) to allow their ends to abut against respective partition walls 10 of housing 3, while the non-displacing wall parts are not pushed by respective terminals 40 but only abut, with their ends, against respective partition walls 10 of housing 3. Whether to form movable walls 15 or the non-displacing wall parts on partition walls 11 is decided by the pitches between terminals in front housing 3 and rear housing 4 of the pitch conversion connector and, thus, movable walls 15 may be provided to all partition walls 11 or, as in this embodiment, movable walls 15 may be provided to some of partition walls 11. Further, though each movable wall 15 is diagonally inclined with respect to base part in this embodiment, movable wall 15 as a whole may bend curvilinearly.

When both housings 3 and 4 are combined together, though movable walls 15 are pushed by respective pitch adjustment parts 48*c* of third terminals 47 to displace in this embodiment, movable walls 15 may be pushed by components other than the terminals to displace. For example, the movable walls may be pushed by the inner wall surfaces of terminal accommodation chambers 8 of front housing 3. Further, in cases such as when each terminal has an integral structure, movable walls 15 may displace upon attachment of the terminals to housing 4 to which movable walls 15 are provided. Such embodiment may also be included in the present invention.

As illustrated in FIG. 4, each movable wall 15 has a thickness substantially identical to that of partition wall 11 and extends by a predetermined length from the end of partition wall 11. The protruding length of movable wall 15 is not particularly limited and it is not always necessary that the end of movable wall 15 abuts against partition wall 11 of front housing 3 when both housings 3 and 4 are combined together. However, in order to reliably prevent short-circuits between adjacent terminals, it is preferable that movable wall 15 has such a protruding length that the end of movable wall 15 can abut against partition wall 10 of front housing 3. Here, in place of or in addition to allowing the end of movable wall 15 to abut against partition wall 10, step part 10*b* may be provided at the end of partition wall 11 and movable wall 15 may connect to partition wall 10 so that the tip of movable wall 15 is disposed in the neighborhood of this step part 10*b*. In this configuration, even if the tip of movable wall 15 does not always abut against partition wall 10, migration of foreign matter through clearances between adjacent terminal accommodation chambers 8 and 9 and the short-circuits between the adjacent terminals can be prevented.

FIG. 3 illustrates a state in which the tips of movable walls 15 abut against respective side surfaces of partition walls 11. The movable walls are not provided on two partition walls disposed in the center of rear housing 4 but, when both housings 3 and 4 are combined together, partition walls 11 disposed in the center of rear housing 4 abut against the respective tips of two partition walls 10 disposed in the center of front housing 3. As a result, independence of terminal accommodation chambers 8 and 9 disposed in the center of connector 1 can be ensured by partition walls 10 and 11, while independence of two terminal accommodation chambers 8 and 9 disposed adjacent to the center of connector 1 can be ensured by partition walls 10 and 11 and movable walls 15. Adjacent terminal accommodation chambers 8 and 9 are separated from each other by the walls and, therefore, it is possible to solve the problem that adjacent terminals are short-circuited via foreign matter and the like.

As described above, according to this embodiment, because movable walls 15 are provided to extend from respective partition walls 11 of rear housing 4 so as to displace and connect to respective partition walls 10 of front housing 3 when both housings 3 and 4 are combined together, movable walls 15 form respective portions of partition walls 10 and 11 that define terminal accommodation chambers 8 and 9 and, as a result, insulation between adjacent terminals 40 can be ensured and reliability of signal connection can be improved. This embodiment is applied to a connector in which terminals are arranged in a single line but, also in a connector in which terminals are arranged in two or more lines stacked vertically, effects similar to those of this embodiment can be exhibited.

While the description has been made hereinabove with respect to an electrical connector in this specification, the present invention is not limited to the disclosed embodiments and modifications and improvements may be made to the embodiments. Though the movable walls are provided on partition walls 11 of rear housing 4 in this specification, movable walls 15 may be provided on partition walls 10 of front housing 3. Further, though terminal 40 is comprised of three types of terminals 41, 44 and 47 that are distinct from each other in one example within this specification, there is no limitation on configuration of terminal 40 and, thus, terminal 40 may be one integrally formed part or first and third terminals 41, 47 may be formed integrally.

DESCRIPTION OF REFERENCE NUMERALS

1 Electrical connector
2 Connector housing
3 Front housing
4 Rear housing
8, 9 Terminal accommodation chamber
10, 11 Partition wall
40 Terminal
41 First terminal
44 Second terminal
47 Third terminal

What is claimed is:

1. An electrical connector in which a pitch between a plurality of terminals accommodated in terminal accommodation chambers of a connector housing is different between one end and the other end of the connector housing, wherein said connector housing comprises a first housing and a second housing that are combined together during assembly and that have respective partition walls that define said terminal accommodation chambers, and wherein a movable wall is provided to extend from said partition wall of one housing to displace to said partition wall of the other housing in a state in which said first housing and said second housing are combined together.

2. An electrical connector according to claim 1, wherein said movable wall has: a base part that is integrally coupled with said partition wall; and a tip part that extends from said base part, wherein, when said first housing and said second housing are combined together, said movable wall is diagonally inclined with respect to said base part to form said terminal accommodation chambers that pass through said first housing and said second housing.

3. An electrical connector according to claim 1, wherein each said terminal has: a terminal connection part to be connected with a terminal of a mating connector at one longitudinal end; a wire connection part to be connected with a wire at the other longitudinal end; and a pitch adjustment part that is disposed between said terminal connection part and said wire connection part, wherein said movable wall is urged by respective said pitch adjustment parts to displace when said first housing and said second housing are combined together.

4. An electrical connector according to claim 1, wherein a first part of each said terminal accommodated in said first housing and a second part of each said terminal accommodated in said second housing are formed as separate parts and the first part of each said terminal and the second part of each said terminal come into electrical contact with each other at a predetermined contact pressure when said first housing and said second housing are combined together.

* * * * *